United States Patent [19]

Fruin

[11] 4,049,318

[45] Sept. 20, 1977

[54] MINING MACHINE WITH CAM-OPERATED WATER JET PUMP

[75] Inventor: Harry James Fruin, Staincross, England

[73] Assignee: Dresser Europe S.A., Brussels, Belgium

[21] Appl. No.: 626,544

[22] Filed: Oct. 28, 1975

[30] Foreign Application Priority Data

Nov. 1, 1974 United Kingdom ..... 47442/74

[51] Int. Cl.[2] ..... E21C 25/60

[52] U.S. Cl. ..... 299/81; 239/101; 299/17

[58] Field of Search ..... 239/101; 299/12, 81, 299/17; 175/67, 422

[56] References Cited

U.S. PATENT DOCUMENTS

| | | | |
|---|---|---|---|
| 3,544,166 | 12/1970 | Proctor | 299/81 |
| 3,729,137 | 4/1973 | Cobb et al. | 239/101 |
| 3,799,615 | 3/1974 | Taylor et al. | 299/81 X |
| 3,897,836 | 8/1975 | Hall et al. | 239/101 X |

FOREIGN PATENT DOCUMENTS

| | | | |
|---|---|---|---|
| 284,933 | 3/1971 | U.S.S.R. | 299/81 |

*Primary Examiner*—Ernest R. Purser
*Attorney, Agent, or Firm*—Larson, Taylor and Hinds

[57] ABSTRACT

A mining machine adapted to traverse a mine face comprises a rotary drum, which may be mounted transversely or forwardly of the machine body, carrying liquid orifices which are supplied with water under pressure so that each orifice produces a water jet of continuously varying pressure which is directed at the material being mined at least for some of the times when the jet pressure is at its maximum value. In operation, reciprocation between a number of pistons and respective bores, the bores being formed in the drum, is brought about as the drum rotates by an eccentric bearing with which the pistons coact. The drum may carry cutting picks to assist the water jet cutting.

22 Claims, 5 Drawing Figures

MINING MACHINE WITH CAM-OPERATED WATER JET PUMP

This invention relates to a mining machine and is concerned more particularly, though not exclusively, with a machine having a water jet cutting drum for material cutting.

According to the invention there is provided a mining machine adapted to work a mine face, comprising a rotary part, a liquid outlet orifice with which the rotary part is provided, and means for supplying liquid under pressure to the orifice so that the pressure of the jet of liquid produced by said orifice varies continuously to reach a maximum value periodically and the jet is directed at the material being mined at least for some of the times when the jet pressure is at its maximum value.

In one preferred construction, there is provided a mining machine adapted to traverse a mine face, comprising a rotary drum, mounted with its axis transverse to the direction of traverse, a liquid outlet orifice with which the drum is provided and which is directed at least partly in the radial direction of the drum, and means for supplying liquid under pressure to the orifice in such manner that as said orifice is brought into the direction of traverse on rotation of the drum, the pressure of the jet of liquid produced by said orifice varies continuously to reach a maximum value when the orifice is pointing so as to have its radial component aligned with the direction of traverse.

In another preferred construction, there is provided a mining machine adapted to traverse a mine face, comprising a rotary drum, mounted to extend generally in the direction of traverse, a liquid outlet orifice with which the drum is provided and which is directed at least partly in the axial direction of the drum towards the material being mined, and means for supplying liquid under pressure to the orifice in such manner that the pressure of the jet of liquid produced by said orifice varies continuously to reach a maximum value periodically.

Figure 1:
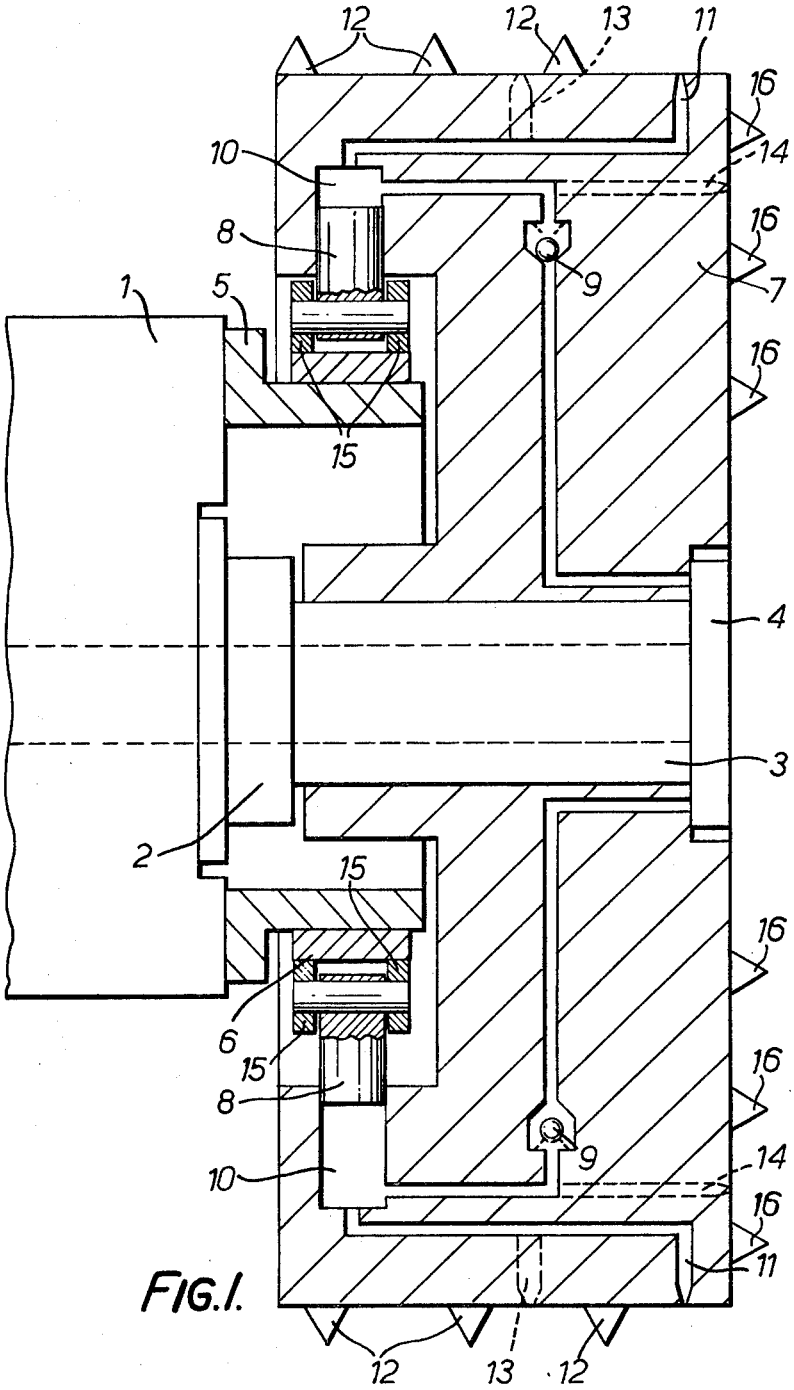
Figure 2:
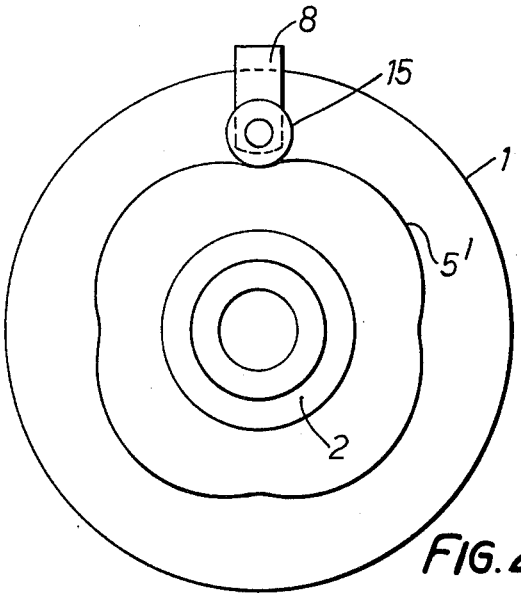
Figure 3:
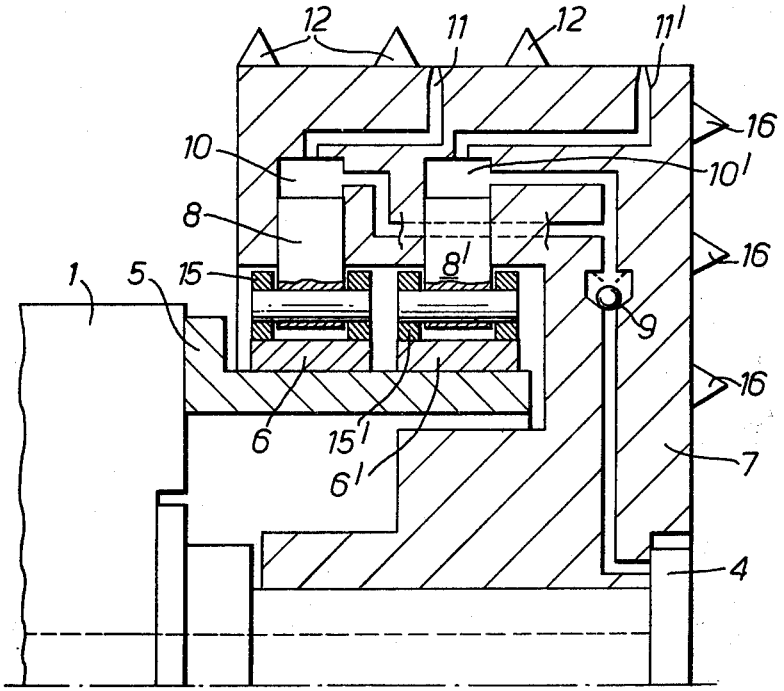
Figure 4:
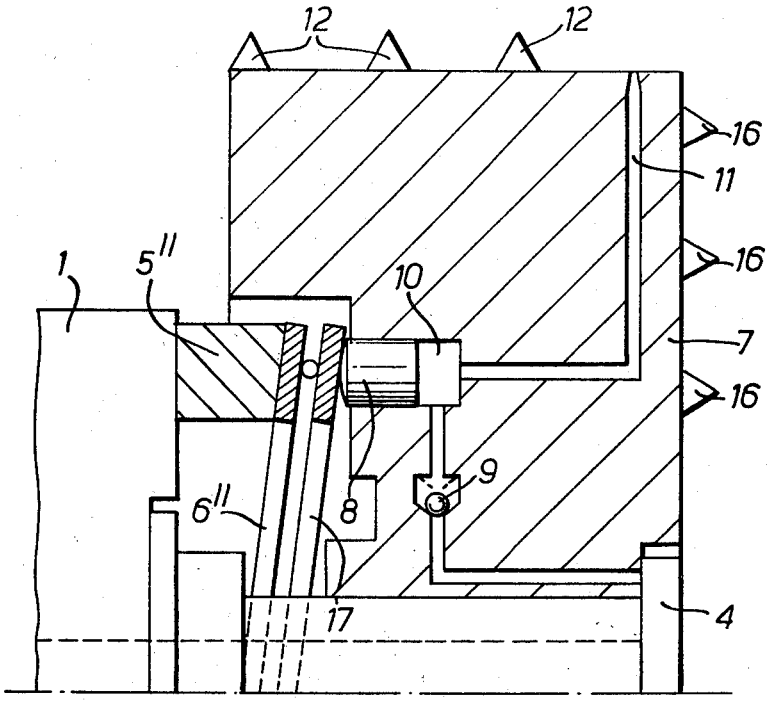
Figure 5:
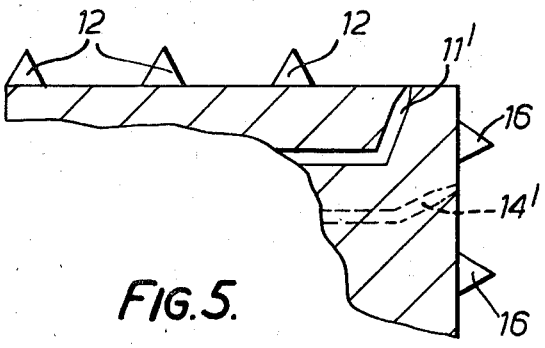

For a better understanding of the invention and to show how the same may be carried into effect, reference will now be made, by way of example, to the accompanying drawings, in which:

FIG. 1 is a vertical section through the cutting drum of one form of mining machine in accordance with the invention, incorporating a single bank of cylinders and pistons to control the water jet pressure, FIG. 2 is a side view of a multi-throw bearing, FIG. 3 shows a double-bank arrangement in vertical section, FIG. 4 illustrates, in vertical section, a modified arrangement for causing the pistons to reciprocate, and FIG. 5 is a fragmentary sectional view of the drum periphery, showing a different orientation of the orifices with which the drum is provided.

Referring to FIG. 1, the machine is a traversing mining machine and comprises essentially a standard body unit 1 and a rotary part in the form of a cutting drum 7. The unit 1 has a bearing housing 2 which carries a hollow drive shaft 3 projecting from the body unit 1. At the projecting, face side, end of the drive shaft 3 is a valve mechanism 4. Mounted onto the unit 1 is an off-centre housing 5 on which is mounted a bearing 6 eccentrically arranged relative to the axis of the shaft 3.

The cutting drum 7, which is secured to the drive shaft 3 for co-rotation therewith, is formed with a number of radial piston bores which provide piston chambers 10 and into each of which is fitted a reciprocable piston 8 which carries rollers 15 at its radially inward end, the rollers being in permanent contact with the bearing 6. Although the drawing shows the use of rollers, other well known expedients for causing the pistons to reciprocate as the drum rotates may be used.

Leading from the valve mechanism 4 to each chamber 10 is a water duct including a non-return valve 9. Each piston chamber leads to an orifice in the form of a radial nozzle 11 at the periphery of the cutting drum by way of a further duct.

In operation, water is supplied at medium pressure through the hollow drive shaft 3 to the valve mechanism 4 which distributes the water via the non-return valves 9 to the piston chambers 10. By virtue of the eccentric arrangement of the housing 5 and bearing 6, as the drive shaft 3 and drum 7 rotate, the pistons 8 reciprocate in their bores, the water pressure in the chambers maintaining the rollers carried by the pistons permanently in contact with the bearing 6. When each piston 8 is moving in the direction to decrease the volume of its piston chamber 10, it forces water in the chamber through the nozzle 11 and thereby intensifies the water pressure to provide a very high pressure water jet, the associated non-return valve 9 preventing the reverse-flow of water in the chamber 10 so as to be forced back to the valve mechanism 4. On the other hand, when the piston is moving at its maximum velocity in the other direction in its bore so as to increase the volume of its chamber 10, the rate at which the volume of the chamber 10 is increasing substantially matches the flow rate of medium pressure water into the chamber from the valve mechansim 4 and the effect of this is that hardly any water or none at all is jetted from the nozzle 11 connected to this chamber. Naturally, the mining machine is used in such a way that the pressure of each of the jets produced by the nozzles varies continuously between substantially zero, when the jet is pointing in the opposite direction to the direction of machine traverse, and a maximum value, when the jet is aligned with the traverse direction. The very high pressure water jets can be used to cut the mineral or merely to assist in cutting of the mineral. In the former case, the mining machine is provided with additional nozzles. For example, for the machine shown in the drawing two additional sets of nozzles 13 and 14 are provided so that each chamber supplies three nozzles 11, 13 and 14, the nozzles 13 being radial nozzles and the nozzles 14 pointing in the axial direction of the drum. In the case of the water jets assisting in cutting the mineral, suitable cutting implements such as picks 12 are fitted to the periphery of the drum. Further picks 16 can be provided on the face side of the drum.

The pistons and nozzles can be of such a size as to consume all the power available at the drum shaft or any proportion of it. If all the power available at the drum shaft is consumed by the very high pressure water system of the cutting machine, then all the cutting is achieved by water jet cutting. If, say, 50% of the power available at the drum shaft is consumed by the very high pressure water system, then 50% of the cutting power is available for water jet cutting and 50% can be used for conventional pick cutting. In both cases, the water jets greatly assist in dust suppression. If the nozzles are further altered so that say 10% only of the power at the drum shaft is consumed by the very high pressure water system, the water system can be used for dust suppression alone by infusing high pressure water into the strata of the working face into which the drum is cutting, thus considerably reducing the environmental dust hazard to personnel working in the vicinity of the mining machine. In this case, practically all the cutting into the working face will be by means of conventional pick cutting.

The use of variable pressure water jets is not restricted to "shearer-type" cutters such as the one described above, but can equally be applied to the case of a machine having a forwardly projecting drum extending generally in the direction of traverse. The arrangement can be essentially identical to that illustrated in FIG. 1 of the accompanying drawings except that in this case it is essential for there to be axially directed nozzles such as 14 and the nozzles 11, 13 become optional. Generally, picks such as 16 are provided, projecting from the forward end of the drum, and it is preferred to include also the picks 12.

An advantage of this forwardly projecting drum arrangement is that considerably higher peak jet pressure values can be reached than the value obtainable if constant pressure jets were to have been used, so that although the pressure regularly drops to below this constant value during the periodic pressure fluctuation of the jets as the drum rotates, the peak pressures enable more efficient cutting of the material being mined.

Envisaged modifications of both the above described mining machines concern the use of a multi-throw eccentric bearing in place of the bearing 6 so that during each revolution of the drive shaft each piston reciprocates more than once. FIG. 2 illustrates a "four-throw" bearing 5 intended for use in a machine having a drum extending generally in the direction of traverse. Alternatively, more than one bank of pistons may be fitted within the cutting drum. Such an arrangement is shown in FIG. 3 where the parts of a second bank are denoted by " ′ " notation.

With reference to FIG. 4, in another embodiment of the invention the pistons are mounted parallel to the axis of the drive shaft of the drum and the pistons are reciprocated by an inclined swashplate 6″. In this case, the pistons can have domed ends pressing against the swashplate through intermediary of a thrust bearing 17.

One advantage of the described cutting drum is that an existing power loader, in which water is fed down a hollow cutting drum drive shaft to which is secured a valve mechanism which distributes the water to a selected number of outlets on the periphery of the cutting drum, can be converted to a mining machine such as the one described by replacing the cutting drum of the power loader by the cutting drum described hereinabove with reference to the accompanying drawing. Clearly, an existing multi-drum power loader can also be converted in this way.

It will be appreciated that in the case of a transversely mounted drum it is not essential for the drum axis to be perpendicular to the direction of traverse. Moreover, for both kinds of machine, the nozzles at the drum periphery and the nozzles on the end face of the drum can in each case have both radial and axial components, as FIG. 5 illustrates.

Although it is clearly desirable for the drum to have a number of nozzles, a workable machine is obtained when the cutting drum has only a single nozzle.

I claim:

1. A mining machine adapted to work a mine face comprising: a non-rotational stationary portion, a rotary part rotatably mounted on the said stationary portion for rotation relative thereto, said rotary part including a liquid outlet orifice constructed such that liquid passes therethrough as a jet, passage means for providing a passage for a liquid through the rotary part to the orifice, said orifice being constructed to provide a jet of liquid, a pump means operatively connected to the rotary part for rotation therewith, a cam bearing fixedly mounted on the said stationary portion and positioned to act directly upon the pump means such that the pump means is operated directly in response to rotation of the rotary part, relative to the stationary part, for supplying the liquid in said passage means to the orifice with a pressure which varies continuously to reach a maximum value periodically, whereby the jet is directed at the material being mined at least some of the times the jet is at or near its maximum pressure.

2. A mining machine as claimed in claim 1, wherein the pump means comprises an arrangement of a piston in a cylinder bore which is in communication with the said orifice, the said arrangement being constructed such that upon rotation of the rotary part, the cam bearing acts directly on the piston to bring about relative displacement between the piston and its bore so as to produce said variation in the pressure of the liquid jet.

3. A mining machine as claimed in claim 2, including a plurality of such orifices and including a respective arrangement of a piston in a cylinder bore in communication with each orifice, and wherein the cylinder bores are radial bores, formed in the rotary part, and the cam bearing is mounted eccentrically relative to the rotary part axis so as to cause the pistons to reciprocate when the rotary part is rotated, thereby to produce said variation in the pressure of the liquid jets.

4. A mining machine as claimed in claim 3, wherein each piston carries rollers at its inner end, the rollers being in permanent contact with the cam bearing.

5. A mining machine as claimed in claim 2, including a plurality of such orifices and including a respective arrangement of a piston in a cylinder bore in communication with each orifice, and wherein the cylinder bores are formed in the rotary part with their axes parallel to the rotary part axis and the cam bearing is an inclined swashplate which causes the pistons to reciprocate when the rotary part is rotated, thereby to produce said variation in the pressure of the liquid jets.

6. A mining machine as claimed in claim 5, wherein each piston has a domed end co-operating with the swashplate through the intermediary of a thrust bearing.

7. A mining machine as claimed in claim 2, including a plurality of such orifices and including a respective arrangement of a piston in a cylinder bore in communication with each orifice, and wherein the said cam bearing is a multi-throw bearing so that for each revolution of the rotary part each piston reciprocates at least twice.

8. A mining machine as claimed in claim 2, including a plurality of such orifices and including a respective arrangement of a piston in a cylinder bore in communication with each orifice, and wherein the pistons and bores are arranged in two or more banks.

9. A mining machine as claimed in claim 2, including non-return valve means in the passage means to prevent reverse-flow of liquid which is supplied to the bore to be expelled through the orifice.

10. A mining machine as claimed in claim 1, wherein the rotary part carries cutting picks.

11. A mining machine adapted to work a mine face, comprising a non-rotational stationary portion, a rotary part rotatably mounted on the said stationary portion for rotation relative thereto, said rotary part including a liquid outlet orifice for providing a jet of liquid, and pump means mounted on the rotary part for rotation therewith for supplying liquid under pressure to the orifice, a cam bearing fixedly mounted on the stationary portion and positioned to act directly on the pump means such that, in use, upon rotation of the rotary part, the pump part is operative to cause the pressure of the jet of liquid produced by said orifice to successively rise and fall in such a manner as at all times to be either rising or falling, reaching a maximum value periodically, whereby the jet is directed at the material being mined at least for some of the times when the jet pressure is at its maximum value.

12. A mining machine as claimed in claim 11, wherein the pump means comprises an arrangement of a piston in a cylinder bore which is in communication with the said orifice, the piston and cylinder arrangement being such that upon rotation of the rotary part the cam bearing acts directly on the piston to bring about relative displacement between the piston and its bore so as to produce the rise and fall in the pressure of the liquid jet.

13. A mining machine as claimed in claim 12, including a plurality of such orifices and including a respective arrangement of a piston in a cylinder bore in communication with each orifice, and wherein the cylinder bores are radial bores, formed in the rotary part, and the cam with a bearing is mounted eccentrically relative to the rotary part axis so as to cause the pistons to reciprocate when the rotary part is rotated, thereby to produce the rise and fall in the pressure of the liquid jets.

14. A mining machine as claimed in claim 13, wherein each piston carries rollers at its inner end, the rollers being in permanent contact with the cam bearing.

15. A mining machine as claimed in claim 12, wherein the pump comprises a plurality of such orifices and a respective arrangement of a piston in a cylinder bore in communication with each orifice, and wherein the cylinder bores are formed in the rotary part with their axes parallel to the rotary part axis and the cam bearing is an inclined swashplate which causes the pistons to reciprocate when the rotary part is rotated, thereby to produce the rise and fall in the pressure of the liquid jets.

16. A mining machine as claimed in claim 5, wherein each piston has a domed end co-operating with the swashplate through the intermediary of a thrust bearing.

17. A mining machine adapted to traverse a mine face, comprising a rotary drum, mounted in bearing means mounted stationarily in the mining machine with the drum axis transverse to the direction of traverse and including a liquid outlet orifice which is directed at least partly in the radial direction of the drum and constructed to provide a jet of liquid, means for supplying liquid to the drum, a pump means incorporated in said rotary part for supplying the said supplied liquid to the orifice, and a cam bearing mounted stationarily in the mining machine and acting directly on said pump means so as to cause said pump means to operate as the drum rotates, whereby as said orifice is brought into the direction of traverse on rotation of the drum, the pressure of the jet of liquid produced by said pump means at the orifice varies continuously to reach a maximum value when the orifice is pointing so as to have its radial component aligned with the direction of traverse.

18. A mining machine as claimed in claim 17, wherein the liquid pump means is so constructed and arranged that, in use, the pressure of the jet of liquid produced by the orifice varies continuously between zero, when the orifice is pointing so as to have its radial component in the opposite direction to the direction of traverse, and the said maximum value, when the said radial component is aligned with the direction of traverse.

19. A mining machine as claimed in claim 17, including cutting picks on the drum periphery and on the face side end of the drum.

20. A mining machine adapted to traverse a mine face, comprising a rotary drum, mounted in bearing means mounted stationarily in the mining machine, the drum axis extending generally in the direction of traverse and including a liquid outlet orifice which is directed at least partly in the axial direction of the drum towards the material being mined and constructed to provide a jet of liquid, said machine further comprising a liquid supplying means, incorporating a pump, included in said rotary part for supplying liquid under pressure to the orifice, and a cam bearing mounted stationarily in the mining machine and acting directly on said pump means so as to cause said pump means to operate as the drum rotates, whereby in use the pressure of the jet of liquid produced by said orifice varies continuously to reach a maximum value periodically.

21. A mining machine as claimed in claim 20, wherein the liquid supplying means is so constructed and arranged that, in use, the pressure of the jet of liquid produced by the orifice varies continuously between zero and the said maximum value.

22. A mining machine as claimed in claim 20, including cutting picks on the drum periphery and on the face side end of the drum.

* * * * *